United States Patent [19]

Sellitto et al.

[11] 4,183,799

[45] Jan. 15, 1980

[54] APPARATUS FOR PLATING A LAYER ONTO A METAL STRIP

[75] Inventors: Thomas A. Sellitto, Chardon; Allen W. White, Harpersfield, both of Ohio

[73] Assignee: Production Machinery Corporation, Mentor, Ohio

[21] Appl. No.: 938,656

[22] Filed: Aug. 31, 1978

[51] Int. Cl.[2] ..... C25D 17/00; C25D 17/12

[52] U.S. Cl. ..... 204/206; 204/DIG. 7

[58] Field of Search ..... 204/206, DIG. 7, 207–211

[56] References Cited

U.S. PATENT DOCUMENTS

| | | | |
|---|---|---|---|
| Re. 23,456 | 1/1952 | Rieger | 204/206 |
| 2,307,928 | 1/1943 | Hogaboom | 204/206 |
| 2,382,018 | 8/1945 | Martin | 204/206 |
| 2,509,304 | 5/1950 | Klein | 204/28 |
| 2,569,577 | 10/1951 | Reading | 204/28 |
| 2,690,424 | 9/1954 | Hassell | 204/206 |
| 2,695,269 | 11/1954 | De Witz et al. | 204/206 |
| 2,989,445 | 6/1961 | Lloyd et al. | 204/28 |
| 3,038,850 | 6/1962 | Wagner | 204/206 |
| 3,287,238 | 11/1966 | Latawiec et al. | 204/140.5 |
| 3,354,070 | 11/1967 | Carter | 204/206 |
| 3,468,783 | 9/1969 | Avellone | 204/207 |
| 3,483,113 | 12/1969 | Carter | 204/206 |
| 3,809,642 | 5/1974 | Bond et al. | 204/DIG. 7 |
| 3,975,242 | 8/1976 | Matsuda et al. | 204/28 |
| 4,025,413 | 5/1977 | Nightingale et al. | 204/DIG. 7 |
| 4,030,999 | 6/1977 | Allen | 204/206 |

FOREIGN PATENT DOCUMENTS

| | | | |
|---|---|---|---|
| 255736 | 7/1926 | United Kingdom | 204/15 |

*Primary Examiner*—T. M. Tufariello

*Attorney, Agent, or Firm*—Meyer, Tilberry & Body

[57] ABSTRACT

An improvement in a device for plating a thin layer of a first metal onto the surface of a generally flat metal strip formed of a second metal as the strip is moving in a selected direction along a given path, wherein the device includes an anode in the chamber and means for supplying electrolyte containing ions of the first metal between the anode and the moving strip. The improvement involves providing the anode as an electrically conductive, non-consumable, anode element having an outer surface with a transverse width substantially as great as the width of the strip. A plenum chamber is formed behind the anode element and generally coextensive with the outer surface of the element so that apertures in the anode element direct jets of electrolyte through the anode element and directly against the surface being plated to provide a uniformly turbulent flow of electrolyte at the surface of the strip.

22 Claims, 23 Drawing Figures

FIG. 16
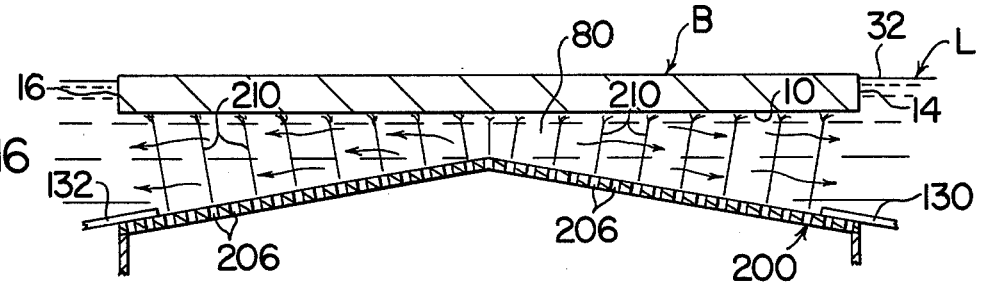
FIG. 17
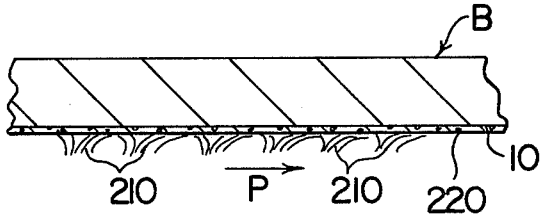
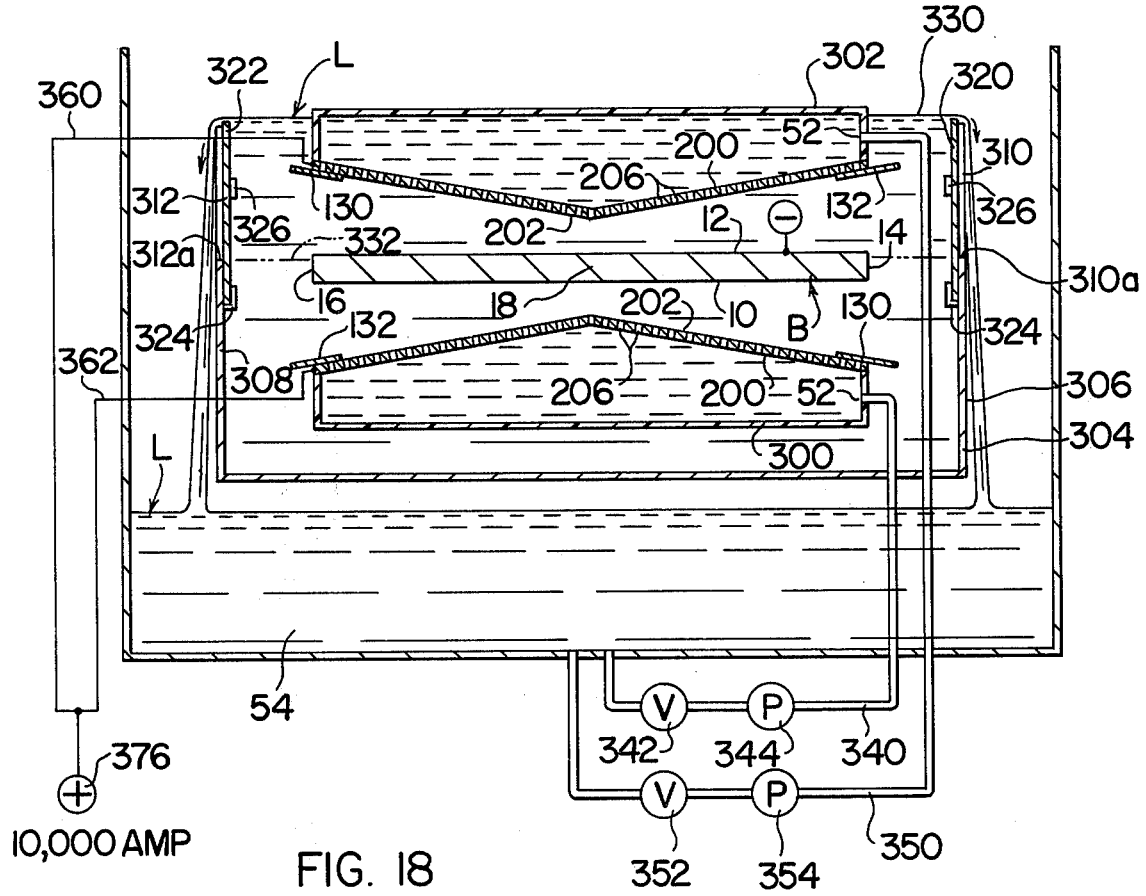
FIG. 18

FIG. 19
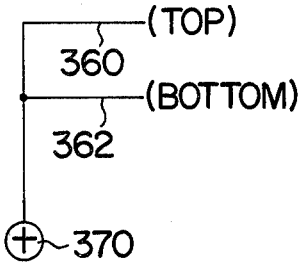
FIG. 19A
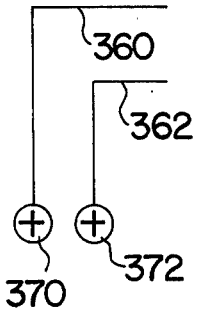
FIG. 19B
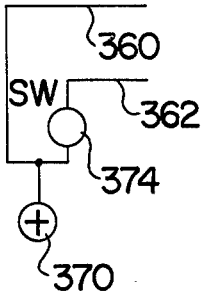
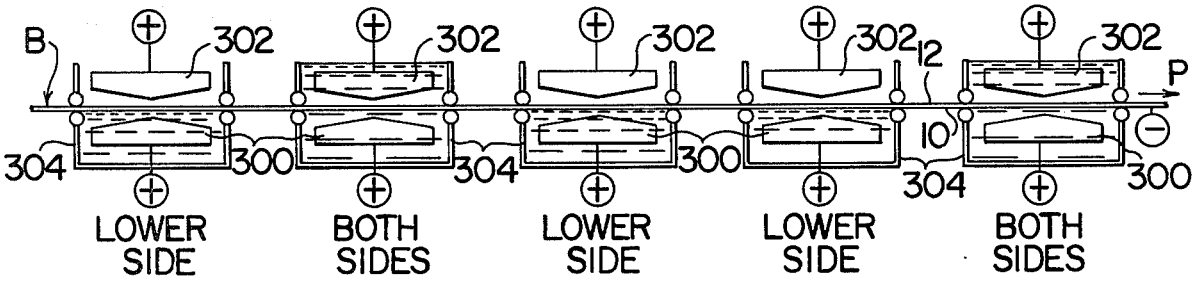
FIG. 20

APPARATUS FOR PLATING A LAYER ONTO A METAL STRIP

The present invention relates to the art of plating a layer of metal on a moving thin metal strip and more particularly to an improved apparatus or device for accomplishing this purpose and the method of using the apparatus or device.

The invention is particularly applicable for plating zinc onto a moving steel strip and will be described with particular reference thereto; however, it is appreciated that the invention has broader applications and may be used in other plating installations wherein a cathodic moving metal strip is plated on at least one surface by a spaced, generally parallel anode.

BACKGROUND OF INVENTION AND PRIOR ART

The art of plating zinc onto a moving metal strip is well developed. Normally, a consumable anode is provided in the plating cell so that the zinc forming the anode is electrically deposited on the moving strip which is connected to a negative D.C. potential with respect to the anode. Representative patents illustrating this concept are U.S. Pat. Nos. 2,382,018; 2,509,304; 2,569,577; 2,690,424; and U.S. Pat. No. RE 23,456. In some instances, the anode is non-consumable and the electrolyte is provided with the zinc compound which provides zinc ions for electrolysis. Representative patents showing non-consumable anodes for use in electroplating are U.S. Pat. Nos. 3,354,070 and 3,483,113. In many instances, the strip is moved longitudinally through one or more plating traps which include an electrolyte and are continuously provided with electrolyte from a lower reservoir into which the electrolyte overflows from the tray. In this manner, an elongated line of trays can be used to plate the desired thickness of material onto a moving strip. Generally, the anodes are provided in the tray and the strip is provided with a negative potential. A representative patent showing this general concept is U.S. Pat. No. 3,468,783. Another patent showing the tray arrangement is U.S. Pat. No. 3,287,238. The current density of the plating process determines the rate at which zinc or other metal is placed onto the strip. As the current density is increased, the plating process is more rapid and the speed of processing of a metal strip is increased. This reduces the length of the line used to obtain a given thickness of plated material or increases the speed at which the strip can be passed through the apparatus during the plating process. Generally, a current density of between 500–2000 ampers per square meter are common. To increase the current density, it is known to increase the velocity of the electrolyte along the strip as shown in U.S. Pat. No. 3,975,242 wherein the strip is passed through a narrow vessel and the electrolyte is passed through this same vessel.

The above discussion is the general background of the present invention and the patents mentioned above are incorporated by reference for the illustrated background information.

The prior art described above does not illustrate a plating device or apparatus wherein one or both sides of a strip can be selectively plated in a tray type plating device using a non-consumable anode and capable of current densities substantially greater than the normal current densities of 500–2000 ampers per square meter.

Also, the prior art discussed above does not illustrate a non-consumable anode for use in a tray type of plating process wherein the anode is economical to produce, allows high current densities and produces uniform results across the width of the strip.

THE INVENTION

The present invention relates to an improvement in the prior apparatus as described above which improvement includes the provision of an anode which is formed from an electrically conductive, non-consumable anode element transversely aligned with the moving strip and extending along the path in which the strip is moving. This anode element has an outer surface with a width substantially as great as the strip width and a plenum chamber is provided coextensive with the outer surface of the anode element. Apertures within the anode element and extending between the plenum chamber and the outer surface over substantially the complete area of the outer surface allow pumping by positive force of an electrolyte containing an appropriate supply of plating ions through the apertures in the form of jets impinging directly upon substantially the total surface of the strip being plated to provide uniformly turbulent flow at the surface. If a single side of the strip is to be plated, a single anode of this type is provided or only one of two anodes is activated. If both sides of the strip are to be plated, two anodes are provided, one on each side of the strip. By providing the high velocity jets impinging directly against substantially the total surface of the strip being plated, the thickness of the ion transfer layer at the strip is decreased substantially. As is well known, the current density in the plating process varies inversely with the thickness of the ion transfer layer at the surface of the strip. By reducing the thickness of the ion layer in accordance with the present invention, the mass transfer rate of the electrodepositing-metal ion is significantly increased and the current density is correspondingly increased for the same applied voltage, such as 12 volts D.C. Thus, the practical effect is the same as though electrolyte resistance is decreased. With respect to this aspect of the invention, three prior patents are pertinent. U.S. Pat. No. 4,030,999 illustrates a plating process wherein a screen is the anode and electrolyte is forced through the anode screen as jets directed against the strip. This provides single side deposition on the strip in a selected area. However, the anode screen does not include a plenum chamber coextensive with the screen so that the electrolyte is distributed equally on the reverse side of the screen and is directed in power jets against the surface to decrease the thickness of the ion transfer layer at the strip. Indeed, the strip is not completely submerged in a manner to give a constant ion transfer layer over at least the entire surface of one side of the strip. U.S. Pat. Nos. 2,989,445 and 3,038,850 relate generally to anodizing the aluminum on one side in the first instance and both sides in the second instance. In U.S. Pat. No. 2,989,445 an upper reservoir is provided with a negative potential and directs electrolyte by gravity through orifices against the upper surface of the strip which is at a positive potential. This concept relates to a gravity flow which distributes electrolyte in a thin layer over the upper surface of the strip. The strip is not submerged in the electrolyte of the tray, nor is the electrolyte directed in high velocity jets toward the surface of the strip to decrease the thickness of the ion transfer layer as contemplated by the above-mentioned aspect of the present invention. In U.S. Pat. No. 3,038,850, the aluminum anodizing process incorporates carbon anodes on each side of the moving foil or strip. Electrolyte is pumped through orifices at the center of the strip only. From there, the electrolyte flows outwardly in the space between the strip and the carbon anodes. This patent does not show the concept of a perforated anode having a coextensive plenum chamber therebehind so that a plurality of high velocity jets can be directed to all surface areas of the strip as the strip is moving through a tray type of electroplating process. These prior art patents are incorporated by reference herein as background information for the anode aspect of the present invention.

With respect to another aspect of the present invention, the electroplating device includes a first anode facing a lower surface of the strip and a second anode facing the upper surface of the strip. Means are provided for selectively changing the electrolyte level in the chamber or tray between a first level covering the strip and both anodes and a second level covering only the lower anode and the strip. In this manner, the electroplating process can be changed between a single side plating and a two side plating process by the provision of an arrangement for reducing the level of electrolyte in the tray of the plating apparatus. By using this concept, especially with the anodes as previously described, it is possible to utilize the novel method of plating a metal strip moving along a longitudinal path with a selected different layer thickness on the upper and lower surface of the strip. In accordance with this method, the strip is provided with a negative potential and there is provided a series of plating cells each including an upper and lower non-consumable anode facing each of the surfaces of the strip. By selecting the number of cells and controlling the level of the electrolyte in each of the cells, the respective cells plate only one side or both sides of the moving strip. In this manner, a desired thickness of plated material can be provided on each side of the strip in a manner heretofore not obtainable. By using this process, one side of the strip can be plated with one metal and the other side of the strip can be plated with another metal. Also, the thickness of the plating on each side of the strip can be controlled to a different thickness irrespective of the type of material plated on both sides of the moving strip.

The primary object of the present invention is the provision of a non-consumable anode for use in plating metal onto a moving metal strip, which anode directs jets of electrolyte containing the plating metal through orifices encompassing the total width of the strip for decreasing the thickness of the ion transfer layer or barrier at the surface to be plated.

Another object of the present invention is the provision of an anode, as defined above, which anode includes a conductive metal element having apertures therein and a plenum chamber behind the anode for forcing electrolyte from the plenum chamber through the anode onto the moving strip.

Still a further object of the present invention is the provision of a non-consumable anode for a plating process, which anode directs jets of electrolyte against a moving strip within a bath of electrolyte to increase the current density of a plating process by decreasing the thickness of the ion layer at the surface of the strip without requiring complicated flow directing mechanisms.

Still a further object of the invention is the provision of an anode, as defined above, which anode includes within the plenum chamber an arrangement for rendering the velocity of electrolyte flow through the anode somewhat uniform over the total surface of the perforated anode.

Still a further object of the present invention is the provision of an anode which can be positioned above and below a moving strip to plate one or both sides of the strip as it moves through a plating tray.

Another object of the present invention is the provision of a method of controlling which anode is active in the above-mentioned arrangement by controlling the level of the electrolyte in the tray.

Yet another object of the present invention is the provision of a method of plating a metal onto a moving metal strip, which method can control the thickness of the coated metal on each side of the strip by controlling the level of the electrolyte in successive trays in a processing unit.

A further object of the present invention is the provision of an anode and method of operating same, which anode and method increases the current density possible in a plating process and provide a convenient way of shifting from one side to two side plating.

Another object of the present invention is the provision of a device for plating metal onto a moving strip wherein a non-consumable anode is spaced from the surface of the strip to be plated, which device maintains the spacing between the anode and strip filled with an appropriate electrolyte which electrolyte is acted upon by high velocity jets from another source of electrolyte. The jets extend from the anode and unite in a high velocity flow across the surface of the strip being plated over its total width. In this manner, the ion transfer layer adjacent the surface being plated is decreased to a minimum and in effect decreases the electrolyte resistance between the anode and the strip and thus allowing higher current densities for the plating process.

Another object of the present invention is the provision of an apparatus and method for plating a moving metal strip which apparatus and method substantially decrease the thickness of the ion transfer layer adjacent the strip being plated.

These and other objects and advantages will become apparent from the following description which includes the drawings set forth in the next section.

BRIEF DESCRIPTION OF DRAWINGS

In the present application, the following drawings are incorporated:

FIG. 16 is a partially cross-sectioned view showing the liquid distribution from the anode as illustrated in FIGS. 12 and 13;

FIG. 17 is a partial view showing the action of the electrolyte flow against the lower surface of a moving strip as contemplated by the present invention;

FIG. 18 is a schematic side elevational view in cross section showing a preferred embodiment of the present invention;

FIGS. 19, 19A and 19B are electrical schematic diagrams showing the connection to the anodes illustrated in FIG. 18; and, FIG. 20 is a schematic view of a novel method utilizing the concept of the invention showing the preferred embodiment of FIG. 18.

PREFERRED EMBODIMENTS

Figure 1:
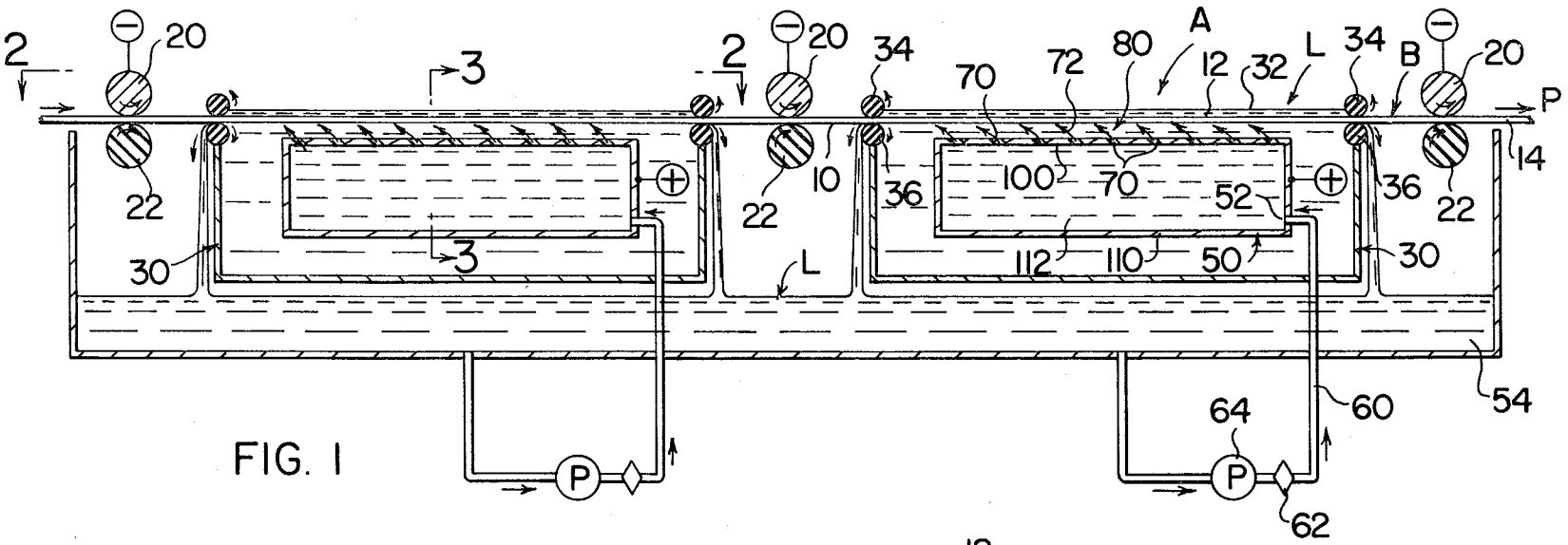
FIG. 1 is a schematic side elevational view showing certain operating characteristics of the preferred embodiment of the present invention.

Referring now to FIGS. 1-4, wherein the showings are for the purposes of illustrating the preferred embodiment of the invention and not for the purpose of limiting same, there is disclosed a device or apparatus A for plating the lower surface 10 of a steel strip B moving in a path P. The strip includes an upper surface 12, parallel edge portions 14, 16 and a center portion 18. The width of the strip W can vary according to the size of the strip being processed by the device A. In accordance with standard practice, contact rolls 20 coacting with back-up rolls 22 apply a negative potential to strip B as it moves along path P through device A. In accordance with somewhat standard practice, a plurality of trays 30, two of which are shown are used for plating strip B. Often these tray types of plating devices plate both surfaces of the strip as it passes through an electrolyte and adjacent a consumable zinc anode. Since the trays 30 are substantially identical, only one of these trays will be described in detail and this description will apply equally to the other tray or trays used in the plating process which in accordance with the present invention plates only the under surface 10 of strip B as it passes through the trays in succession. As will be explained later, if both surfaces of the strip are to be plated in a tray, a second anode arrangement is provided in accordance with the present invention. Within tray 30 there is provided an appropriate electrolyte L which, in practice, is a solution of sulfuric acid containing zinc sulfate which provides zinc ions for electroplating onto surface 10 of moving strip B. Electrolyte L is maintained in tray 30 to an appropriate level 32 which in practice is above upper surface 12 of strip B. Since only the lower surface of the strip is being plated, it is essential that the electrolyte contact only the lower surface of the strip; however, since the strip may form a catenary in the tray, level 32 is maintained above the upper surface 12 of strip B. At each end of tray 30 there is provided standard dam rolls 34, 36 which allow an overflow of electrolyte from between the rolls or over the top of the rolls to remove the electrolyte from tray 30 and maintain level 32 within certain general limits. In accordance with the invention, there is provided a hollow anode 50 formed from non-consumable materials. The electrical circuit is completed at the non-consumable anode because water is oxidized to give up electrons to the external electrical circuit in the same amount as required to neutralize the positively charged zinc ions for deposition at the strip surface. An electrolyte inlet 52 directs electrolyte from reservoir 54 through conduit 60 which includes a filter 62 and an appropriate pump 64. As schematically illustrated in FIG. 1, and as will be described in more detail later, hollow anode 50 includes a plurality of orifices or apertures 70 which create high velocity liquid jets 72 formed from electrolyte forced through orifices or apertures 70 against surface 10 by the pressure created with pump 64. This pressure is sufficient so that the jets actually impinge at high electrolyte flow rates across the lower surface 10 of strip B. By this direct contact effect of the jets impinging upon strip B, the ion transfer layer thickness at surface 10 is decreased to a relatively low amount which approaches zero. Of course, the layer does not reach zero and includes at least a single molecular layer which can not be scrubbed from surface 10 by the action of the several liquid jets 72. As will be explained later, the number of orifices or apertures 70 is selected so that the total surface of strip B over anode 50 is acted upon by the liquid scrubbing action of jets 72 being propelled through electrolyte L within tray 30.

As so far explained, as strip B passes along path P through device A, the strip is cathodic and a non-consumable anode 50 is provided. This anode is electrically positive with respect to the cathode strip and is spaced only slightly therefrom to create a space 80 which is filled with electrolyte and continuously agitated by the high velocity jets of electrolyte passing in straight uninhibited, unobstructed paths from the orifices or apertures 70 to surface 10. This combined submersion of surface 10 and agitation by high velocity unobstructed electrolyte jets from the anode decreases the thickness of the current density controlling ion transfer layer. By maintaining surface 10 submerged in electrolyte and agitated by high velocity jets, the thickness of the ion layer is decreased and high electrodeposition rate can be provided. Accordingly jets 72 are created at each of several apertures covering the upper surface of anode 50. As will be explained later, these jets have sufficient velocity to travel through electrolyte L and provide high solution flow over surface 10. By retaining the same voltage which in practice is approximately 12 volts D.C., the higher solution flow across the strip surface in space 80 permits substantially increased current flow between the anode and surface 10. This current flow in practice has been found to be substantially above approximately 10,000 ampers per square meter using the anode concept as generally described above and which will be described in more detail hereinafter. In addition to the substantial increase of the permissible current density because of uniform turbulence of electrolyte flow due to the anode jets, the electrolyte flow through the anode also decreases the anode polarization by sweeping away oxygen gas that forms at the anode surface due to oxidation of water. In this manner, the electrical energy will be minimized for accomplishing zinc plating on the moving strip.

Figure 2:
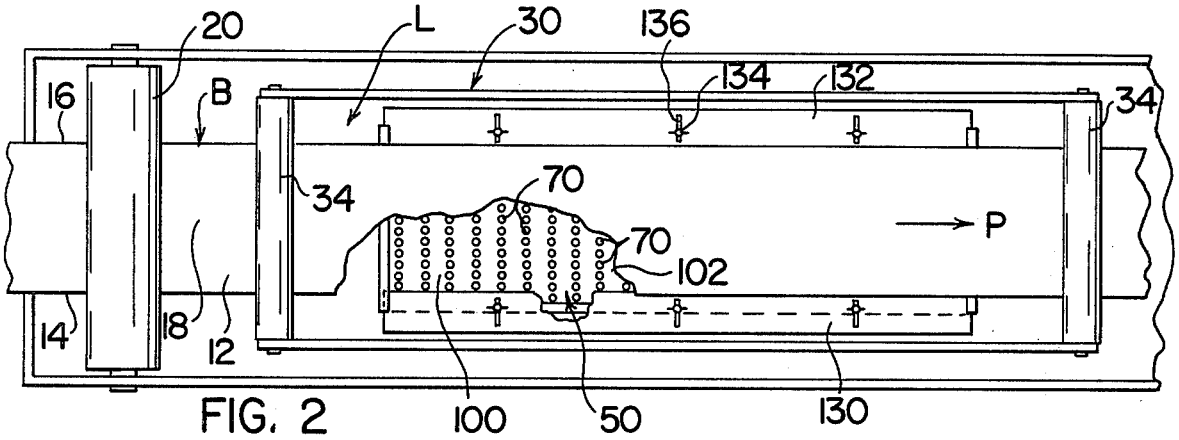
FIG. 2 is an enlarged top, partially cross-sectioned, view taken generally along line 2—2 of FIG. 1.
Figure 3:
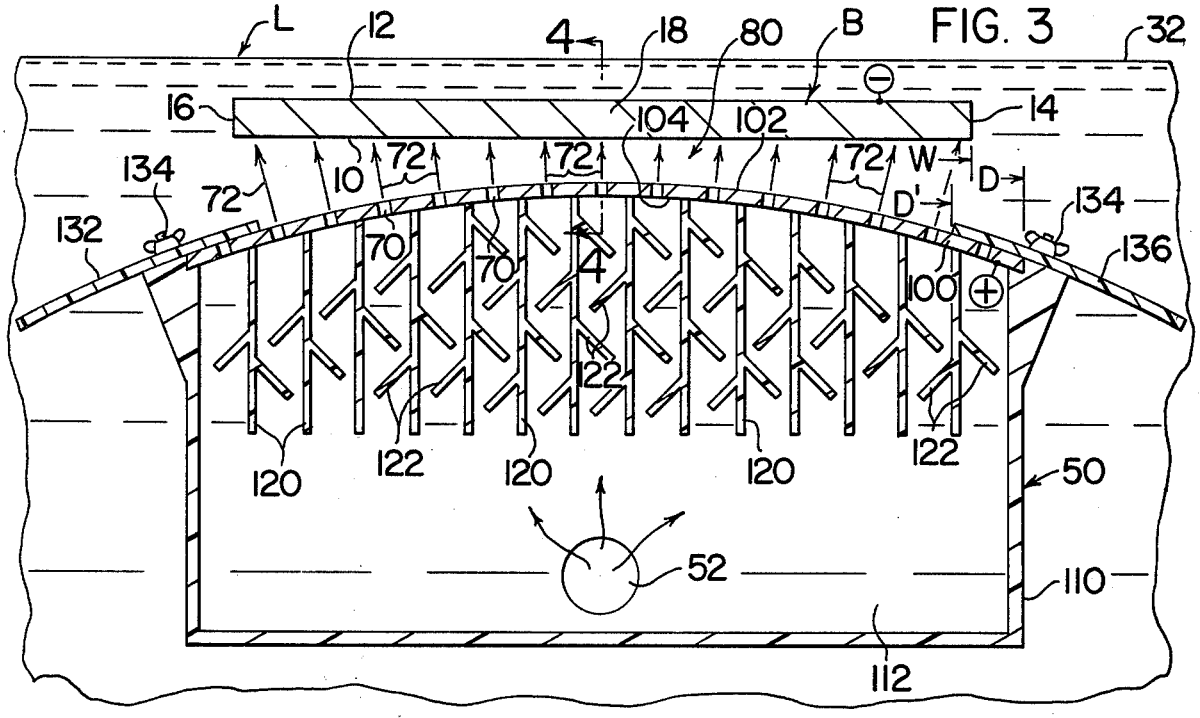
FIG. 3 is an enlarged cross-sectional view taken generally along line 3—3 of FIG. 1.

Referring now more specifically to FIGS. 2 and 3, anode 50 is a hollow structure including a conductive element 100 formed from a non-consumable, electrically conductive material. The term "non-consumable" indicates that sheet 100 does not change form or weight while functioning as an anode in relation to surface 10 of moving strip B. In practice, anode 100 is formed from perforated steel coated with a layer of metal including 90% lead and 10% tin. Anode 100, as shown in FIG. 3, is curved so that the space 80 increases outwardly from the center portion 18 of strip B to the outer edge portions 14, 16, respectively. This allows a more even distribution of current density which will reduce the general tendency of the strip to overplate along the edges of the strip. By curving the anode, the resistance of the electrolyte adjacent the edges is increased by increasing the spacing through which the electrical current must flow between surface 102 and surface 10. Anode 50 is hollow and is closed by a rearward housing 110 forming a plenum chamber 112 for directing electrolyte from inlet 52 through the apertures or openings 70 within conductive sheet 100. Housing 110 is electrically non-conductive and also non-consumable in the plating process. In practice, the housing is formed from a high strength plastic such as CPVC which is a high strength polyvinylchloride well known in the trade. Of course, the housing could be formed from steel having an outer coating of rubber or other materials including plastics which are common practice in the plating art. As so far described, conductive anode 100 has a width D which is generally the same as but greater than the width of the strip being plated. Of course, the width of the strip W varies according to the strip being plated. The spacing between surface 102 and surface 10 is such that jets 72 cause turbulent agitation at surface 10 before being dissipated by the body of effluent within space 80. In the center, the spacing may be relatively small in the neighborhood of approximately 2–3 centimeters. To control the velocity of jets 72, the pressure differential between outer surface 102 and inner surface 104 of sheet 100 is equalized and is not affected by the position of inlet 52 for housing 110. To accomplish this, an appropriate baffling arrangement is provided within plenum chamber 112. In the illustrated embodiment of FIG. 3, the baffling arrangement includes vertically depending, longitudinally extending baffles 120 extending the total length of housing 110 and element 100. The baffles are provided with downwardly angled deflectors 122. These baffles and deflectors equalize the pressure within plenum chamber 112 so that the pressure differential between surfaces 102, 104 is stabilized. Consequently, the velocity of liquid jets 72 is relatively constant and is controlled by the size of the openings 70. As the openings are made larger, the velocity of the jets becomes less. In each instance, it is anticipated that the jets actually cause turbulent agitation at surface 10 to reduce the thickness of the ion transfer layer on this surface which allows a drastic increase in the current density for electrodeposition of a metal on surface 10. This increase in the current density together with the uniformity of the current density created by the curvilinear contour of element 100 provides a relatively uniform, high current density for the plating process which reduces the time which the metal must be subjected to the electrolysis process to obtain a given thickness of plated material on surface 10. Thus, a fewer number of cells may be used and/or the speed of the strip may be increased to produce a preselected plated thickness for the metal being plated onto the strip.

As the width of the strip being plated changes, the effective width D′ of surface 102 on element 100 must be changed accordingly to prevent overplating along the outer edges of the strip. To adjust the effective width D′ of element 100 with respect to the width W of strip B, there is provided electrically non-conductive, non-consumable sheet baffles 130, 132 extending along the edges of sheet 100. Material forming these sheet baffles 130, 132 may be the same material as used in forming the housing 110. To change the effective width D′ of sheet element 100, baffles 130, 132 are adjustable in a transverse direction by an appropriate arrangement, schematically illustrated as a plurality of wing nuts 134 coacting with transversely extending slots 136. When plating strip B, baffles 130, 132 are adjusted inwardly until there is no wrap-around or overplating at the edges of strip B. It has been found that the effective width D′ is less than the width W of the strip being plated. As will be explained later, this decrease in width D′ apparently reduces the current paths passing through the electrolyte and concentrated at the edge portions of strip B. By adjusting the non-conductive shields or baffles 130, 132 inwardly, the thickness of the plating adjacent edge portions 14, 16 is reduced somewhat to prevent overplating at these surfaces. This is also a factor of the current paths formed from the positive surface 102 to the negative surface 12.

Figure 4A:
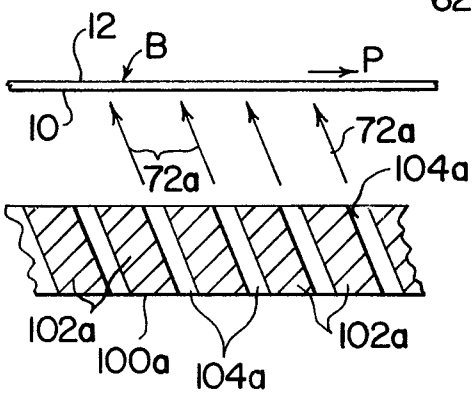
FIG. 4A is a schematic cross-sectional partial view of a preferred type of anode structure.
Figure 4:
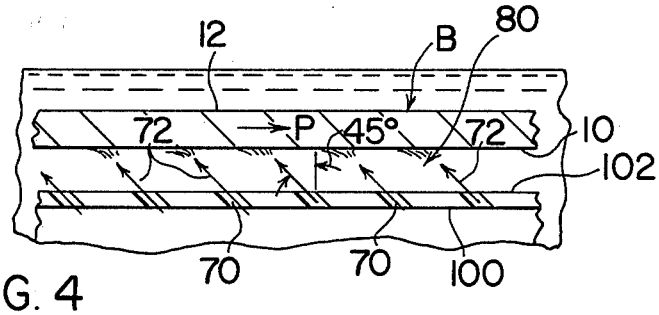
FIG. 4 is an enlarged partial cross-sectional view taken generally along line 4—4 of FIG. 3.

In accordance with another aspect of the invention, the apertures 70 of anode element 100 are angled backwardly in a direction opposite to the path P of moving strip B. This is schematically illustrated in FIG. 4. This backward angled direction of openings, orifices or apertures 70 causes a sliding action of the liquid jet as it impinges directly upon surface 10 to coact with the movement of strip B to produce a higher velocity differential between the impinging jets 72 of electrolyte and moving strip B. The effective electrolyte velocity at surface 10 is increased by this angled direction of the high velocity electrolyte jets extending through space 80 and impinging upon surface 10 because the relative velocity includes a component of the liquid velocity of the jet. In the preferred embodiment of this aspect of the invention, the angle of the jets is approximately 45° with respect to a vertical direction as schematically illustrated in FIG. 4. In FIG. 4A, a preferred anode 100*a* includes a plurality of angled non-consumable anode bars 102*a* defining transverse slots 104*a* through which electrolyte passes in sheet-like jets 72*a*. Element 100*a* operates essentially like anode element 100.

Figure 5:
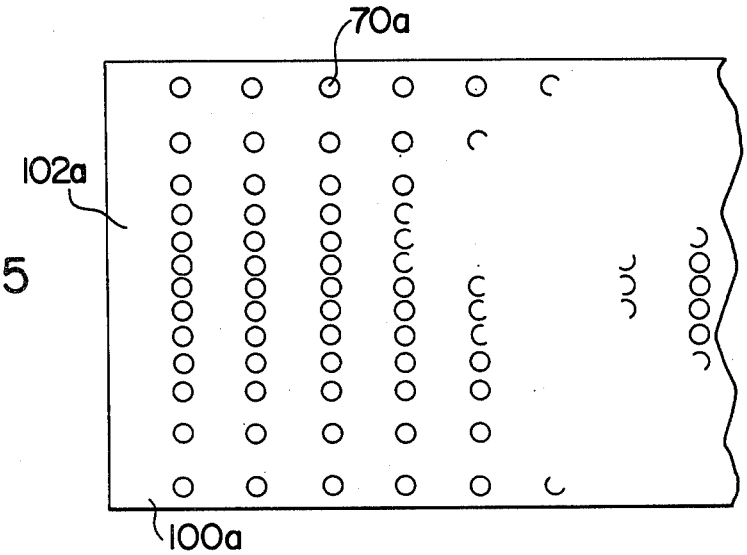
FIGS. 5–9 are schematic views illustrating the apertures or orifices used for the anode in accordance with the present invention.
Figure 6:
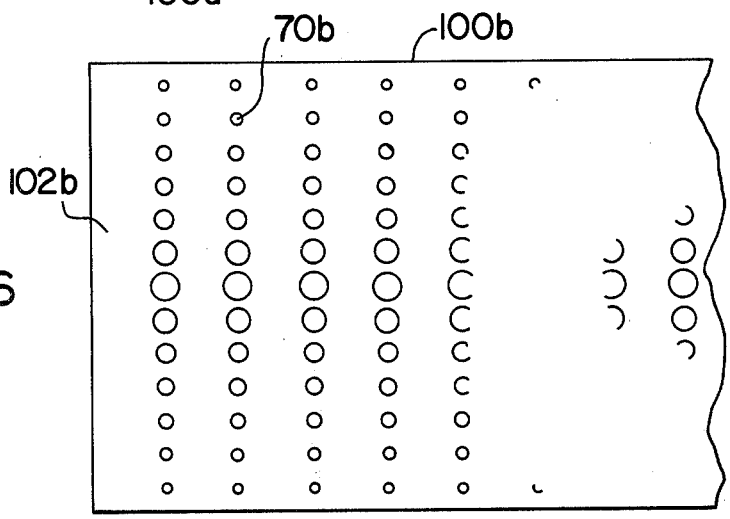
Figure 7:
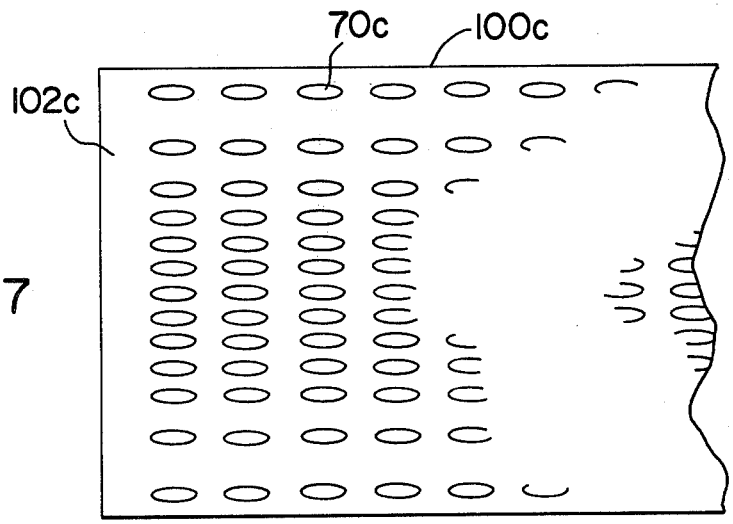
Figure 8:
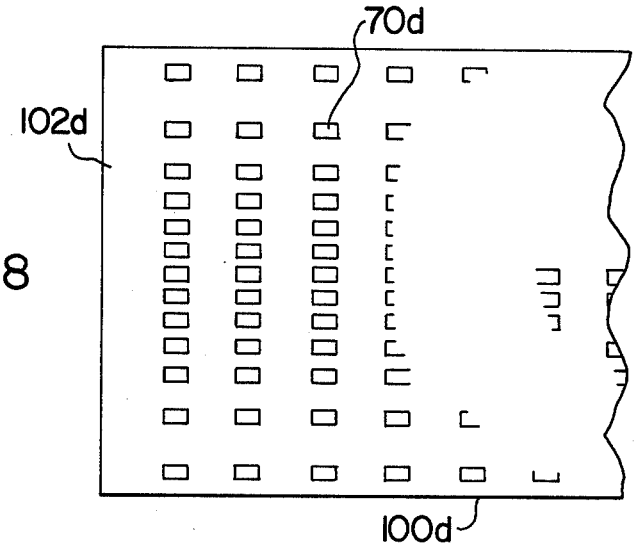

Referring now to FIGS. 5–9, another aspect or modification of the present invention is illustrated. In this concept, a lesser amount of electrolyte is pumped as electrolyte jets in the area of the outer portion of surface 10 than in the area of the center portion thereof. A variety of arrangements could be used to provide greater electrolyte volume for the jets as the distance from the center of surface 10 increases toward the edge portions of the surface. Various arrangements for this purpose are illustrated in FIGS. 5–9 wherein the orifices or openings 70*a*–70*e* are provided on surfaces 102*a*–102*e* of sheet elements 100*a*–100*e*. As can be noted, by spacing the orifices a greater transverse distance, as shown in FIGS. 5, 7 and 8, the volume of electrolyte being jetted to the surface of the strip is decreased from the center portion of the anode sheet element to the outer portion of the anode sheet element.

Figure 9:
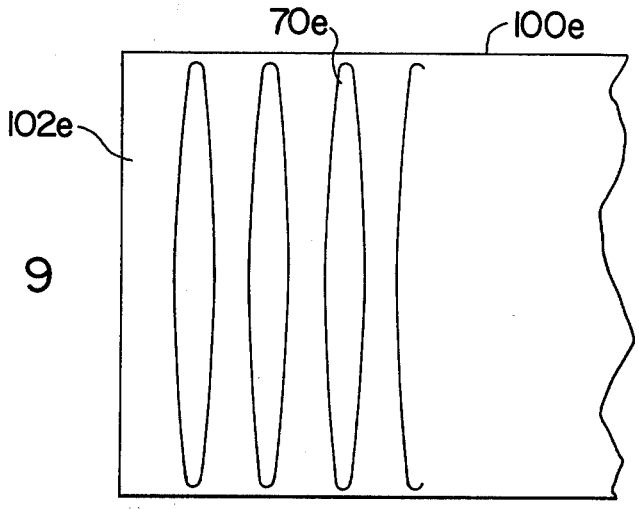

This feature can also be accomplished by decreasing the size of the orifices or openings as shown in FIG. 6. A contoured orifice or opening may also be provided as shown in FIG. 9. In each of these instances, a decreased volume of electrolyte is provided in space 80, in a gradual manner, as the orifice distance increases from the center portion of anode sheet 100 and the edge portions of this sheet. By this modification, the volume rate and, therefore, the velocity of the electrolyte flow adjacent the strip is maintained uniform even though there is a larger spacing between the anode and strip adjacent the outer edge portions of the strip. This uniformity can be controlled also by the taper of the anode.

Figure 10:
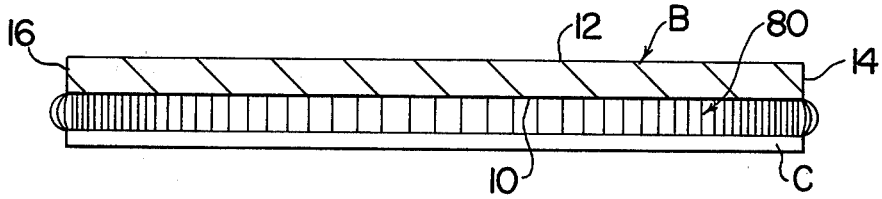
FIG. 10 is a prior art view showing current distribution between an anode and a metal strip.
Figure 11:
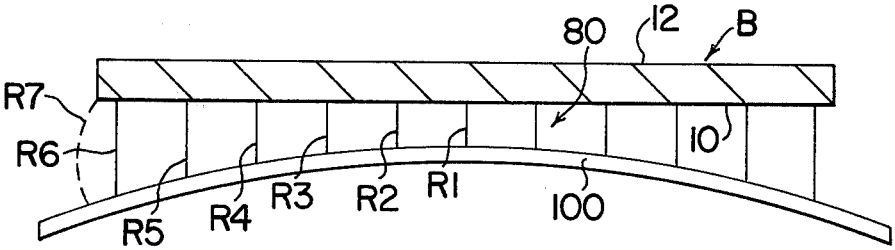
FIG. 11 is a schematic view similar to FIG. 10 showing operating characteristics of the embodiment of the invention shown in FIGS. 1-4.

Referring now to FIGS. 10 and 11, if the anode C is spaced uniformly from surface 10 of strip B, the current density adjacent the outer edge is increased. This causes a heavier plated layer at the edge portions 14, 16 and also a certain amount of metal deposition around these edge portions during the plating process. By providing a curvilinear surface as shown in FIG. 11 for anode element 100, the current density is more uniform in that a longer electrolyte path is provided adjacent the outer portions of the strip. The current paths are schematically illustrated as R1–R6. The current path R7 represents parallel resistance paths adjacent the edge portions of the strip. These paths increase the plating at the edge portion even with a controured surface. Because of the extra current paths adjacent the edge portion, the baffles or shields are used as previously described. FIG. 11 schematically illustrates one concept found to exist in the preferred embodiment. The baffles 130, 132 shown in FIG. 3 can be moved transversely to change the current paths for reducing the overplating along the edges of the strip and the thickness of the plated layer adjacent the edge portions of the strip.

Figure 12:
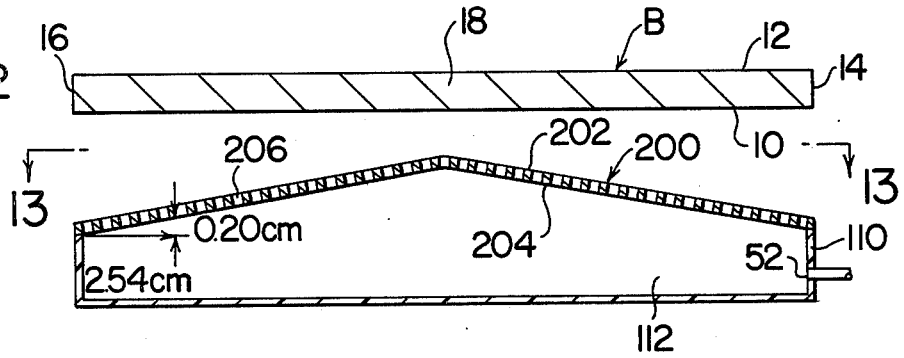
FIG. 12 is a schematic cross-sectional view showing a modification of the embodiment of the invention shown in FIG. 3.
Figure 13:
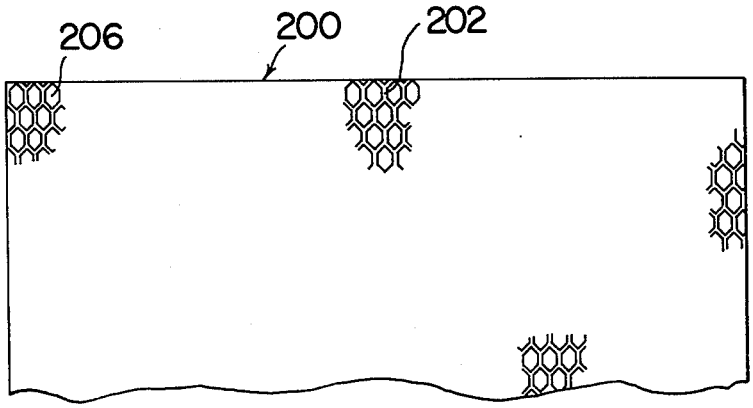
FIG. 13 is a top view taken generally along line 13—13 of FIG. 12.
Figure 14:
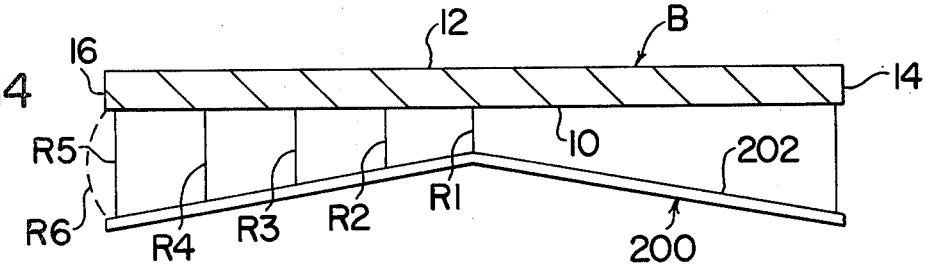
FIG. 14 is a schematic view showing operating characteristics of the embodiment of the invention shown in FIGS. 12 and 13.
Figure 15:
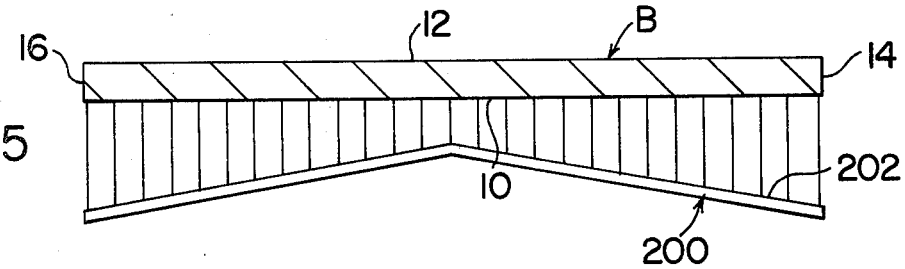
FIG. 15 is a view similar to FIG. 14 showing current distribution between the sheet anode and strip using the modified embodiment of the present invention.

Referring now to FIGS. 12–15, the preferred transverse contour and construction of the anode sheet element is schematically illustrated. Anode element 200 is formed from standard expanded metal such as steel having a general upper surface 202 and a general outer surface 204. Of course, these surfaces are not smooth and include the normal rippled texture of expanded metal. The expanded metal is steel coated with a lead alloy, as previously described. Of course, other metals, such as nickel-cobalt-silicon alloy, could be used. The expanded metal has openings or apertures 206 which openings form approximately 25%–50% of the total surface 202. Element 200 tapers outwardly from the center portion of an angle indicated on FIG. 12. The anode as schematically illustrated in FIGS. 12 and 13 functions in accordance with the description of the embodiment of the invention illustrated in FIGS. 1–4. Referring to FIG. 14, the tapered element 200 increases the spacing of the anode from the center to the outward portions of the moving strip. This contour has a tendency to equalize the current density, as schematically illustrated in FIG. 15, wherein the spacing of the vertical lines illustrates current density distribution over surface 10 of strip B as the spacing of the lines in FIG. 10 shows a variable current density.

Referring now to FIGS. 16 and 17, these figures show the action of the electrolyte jets propelled from the orifices or apertures in the anode as they impinge upon surface 10 of moving strip B. As can be seen, jets 210 are propelled from openings or apertures 206 to impinge at an angle on surface 10. These jets are propelled through the electrolyte filling space 80 so that the electrolyte of the jets after direct impingement upon surface 10 combines with the existing electrolyte to cause a composite liquid flow as indicated by the arrows in FIG. 16. This flow is outwardly from the center of space 80. As shown in FIGS. 17, jets 210 wipe the ion layer 200 to decrease the thickness of this layer to a minimum thickness on surface 10 and in effect substantially reduces the resistance of the plating operation. This allows an increase of the current density from normal 500 to 2000 ampers per square meter to over 10,000 ampers per square meter for the same 12 volt D.C. potential applied across the anode and cathode of the plating apparatus. By providing a larger volume of electrolyte toward the outer edges of the anode and strip as used in one embodiment of the invention, the velocity of electrolyte flow is maintained as the thickness of space 80 increases. In the embodiment shown in FIGS. 12–17, which is preferred, the apertures or openings are uniformly distributed over element 200. Thus, the electrolyte flow is generally the same for all areas of surface 202. The increased spacing of surface 202 still allows uniform electrolyte flow, as the center jet electrolyte combines with the outer jet electrolyte. The taper or surface 202 takes this factor into consideration to allow generally even flow from space 80. Of course, modified anode openings could also be used to assist in maintaining a uniform velocity of electrolyte along the strip.

Referring now to FIG. 18, an arrangement for using the invention as so far described to plate either lower surface 10 or upper surface 12 of strip B or both surfaces is schematically illustrated. Lower anode 300, constructed like the anode of FIGS. 12 and 13, extends along the lower surface of strip B in tray 304 in the manner previously described. In this embodiment of another aspect of the invention, a second anode 302 extends along upper surface 12 of moving strip B. In this instance, tray 304 includes sidewalls 306, 308 including side openings 310, 312 having upper edges 310*a*, 312*a*, respectively. These upper edges serve as auxiliary weirs to control the level of electrolyte L in a manner to be described later. Openings 310, 312 of sidewalls 306, 308 are closed in FIG. 18 by plates 320, 322 held in position over the openings by bottom lugs 324 and side lugs 326, two of which are shown. With plates 320, 322 in place, the electrolyte level in tray 304 is level 330. The electrolyte flows over the top of sidewalls 306, 308 as previously discussed. To provide pressurized electrolyte within the anodes 300, 302 there is provided a line 340 connecting reservoir 54 with inlet 52 of anode 300. A valve 342 opens line 340 for pumping of electrolyte L from the reservoir into anode 300 by a pump 344. In a like manner, electrolyte L is provided within anode 302 by line 350 having a selectively operated valve 352 and a pump 354. One or both of the anodes can be provided selectively with electrolyte L for a plating operation as previously described in conjunction with the other embodiments of the present invention. To provide the electrical current for anodes 300, 302, there are provided leads 362, 360, respectively. These leads are connected to a common positive potential lead 370 of the D.C. power supply used in the plating process.

By using the aspect of the invention as illustrated in FIG. 18, the bottom surface 10 may be plated by removing plates 320, 322 from openings 310, 312, respectively. This lowers the level of electrolyte to the level 332 which is below anode 302 and generally corresponds to level 32 of FIG. 1. Thus, anode 302 is inactive even though connected to the positive lead 370. By closing valve 352, a single side plating process is obtained. If both sides are to be plated, the plates 320, 322 are replaced. Valve 352 is opened and both surfaces 10, 12 are plated. Thus, by using an arrangement for reducing the level of electrolyte within tray 304 the apparatus as illustrated in FIG. 18 can be easily converted from a single side plating arrangement to a two side plating arrangement. It is also possible to plate only the upper surface 312 in the apparatus as shown in FIG. 18. This can be done by employing the electrical circuitry shown in FIGS. 19A or 19B. The showing of FIG. 19 is a schematic illustration of the electrical circuitry used in FIG. 18. Referring now to FIG. 19A, a second power supply is provided with a positive lead 372 electrically distinct from lead 370. If only the upper surface 12 of strip B is to be plated, lead 372 is disconnected. This supplies power therefore only to anode element 200 of upper anode 302. In this manner, only the upper surface is plated even though the electrolyte is at the level 330. Of course, in this instance, the electrolyte will not be pumped through lower anode 300. To do this, valve 342 is closed. A similar arrangement could be accomplished with a single positive potential lead 370 by providing a switch 374 between lead 370 and input lead 362 of anode 300 as shown in FIG. 19B. By opening switch 374, electrical potential is created only between the upper anode 302 and strip B. By using the circuitry as shown in FIGS. 19A, 19B and the structure shown in FIG. 18, either the top surface, bottom surface or both surfaces can be plated as the strip B is passing through tray 304.

Referring now to FIG. 20, a method utilizing the structure shown in FIG. 18 for selective plating of both sides of strip B is schematically illustrated. By controlling the level of electrolyte within tray 304 and electrolyte flow to anodes 300, 302, either the lower side or both sides of strip B are plated. In the arrangement illustrated in FIG. 20, five units are used for plating the lower surface and only two units are used for plating the upper surface. Thus, a substantially heavier layer of material is plated on the lower surface of strip B. It is also possible to use this concept to plate the upper surface only as previously described. Also, different metals can be plated on different surfaces by using a series of trays with the controllable electrode arrangement as shown in FIG. 18 and containing different electrolyte.

Having thus defined the invention, it is claimed:

1. In a device for plating a thin layer of a first metal onto a downwardly facing surface of a generally flat metal strip having a downwardly facing surface, an upwardly facing surface, and a width, said metal strip being formed from a second metal as the strip is moving in a selected direction along a given path through a chamber filled with a stable electrolyte containing a supply of ions of said first metal, said strip having a longitudinal center portion and outer longitudinal edge portions generally defining the width of said strip, said device including means for making said strip a cathode and an anode in said chamber and coextensive with and generally parallel to said lower surface to define a space between said anode and said lower surface and means for applying a voltage differential between said strip and said anode to electrically deposit said ions onto said lower surface of said moving strip, the improvement comprising: said anode including an upper electrically conductive, non-consumable, element transversely aligned with said center portion of said strip and extending along one side of said space, said conductive element facing said moving strip and extending along said path, said element having a transversely contoured outer surface with a transverse width substantially as great as said strip width, and facing said downwardly facing surface, said outer surface contour being generally convex and having a center portion and edge portions with said center portion being closer to said center portion of said strip than said edge portions are to said edge portions of said strip; means for maintaining electrolyte in said space; means forming a plenum chamber communicated with said element; closely spaced apertures in said element between said plenum chamber and said outer surface over substantially the complete area of said outer surface; means for forcing said electrolyte into said plenum chamber, through said apertures and through said space to impinge as jets against said downwardly facing surface of said moving strip; and, means for preventing plating of said second metal onto said upwardly facing surface.

2. The improvement as defined in claim 1 wherein said plating preventing means includes electrically non-conductive, elongated shields extending along said edge portions of said outer surface and between said edge portions of said outer surface and said edge portions of said strip and means for adjusting said shields transversely of said outer surface to prevent plating around the longitudinal edge portions thereof.

3. The improvement as defined in claim 2 wherein said apertures are angled toward said downwardly facing surface in a direction opposite to said given direction.

4. The improvement as defined in claim 1 wherein said apertures are angled toward said downwardly facing surface in a direction opposite to said given direction.

5. The improvement as defined in claim 1 wherein said plenum chamber is non-conductive and said electrolyte forcing means includes an opening in said plenum chamber and means for forcing electrolyte through said opening and into said plenum chamber.

6. The improvement as defined in claim 3 including means in said plenum chamber for equalizing the velocity of said electrolyte passing through said apertures.

7. The improvement as defined in claim 2 including means in said plenum chamber for equalizing the velocity of said electrolyte passing through said apertures.

8. The improvement as defined in claim 1 including means in said plenum chamber for equalizing the velocity of said electrolyte passing through said apertures.

9. The improvement as defined in claim 1 wherein the ratio of aperture area to total surface area at the edge portions of said outer surface is lesser than the ratio of apparatus area to total surface area at the center portion of said outer surface.

10. The improvement as defined in claim 3 wherein the ratio of aperture area to total surface area at the edge portions of said outer surface is lesser than the ratio of apparatus area to total surface area at the center portion of said outer surface.

11. The improvement as defined in claim 4 wherein the ratio of aperture area to total surface area at the edge portions of said outer surface is lesser than the ratio of apparatus area to total surface area at the center portion of said outer surface.

12. The improvement as defined in claim 1 wherein said apertures have an effective opening area which area decreases from said outer portion to said edge portions.

13. The improvement as defined in claim 3 wherein said apertures have an effective opening area which area decreases from said outer portion to said edge portions.

14. The improvement as defined in claim 4 wherein said apertures have an effective opening area which area decreases from said outer portion to said edge portions.

15. The improvement as defined in claim 1 wherein said contour forms an angled outer surface tapering from said center portion to said edge portions.

16. The improvement as defined in claim 1 wherein the area of said apertures is in the range of 25%–50% of the area of said outer surface.

17. In a device for plating a thin layer of a first metal onto one or both surfaces of a generally flat metal strip formed of a second metal as the strip is moving in a selected direction along a given horizontal path through a chamber filled with a stable electrolyte containing a supply of ions of said first metal, said strip having an upper surface, a lower surface, a longitudinal center portion and outer longitudinal edge portions, said device including means for making said strip a cathode, a first anode facing said lower surface and a second anode facing said upper surface, the improvement comprising means for selectively changing the level of electrolyte in said chamber between a first level with said electrolyte covering said strip and said anodes and a second level with said electrolyte covering only said first anode and at least a portion of said strip.

18. The improvement as defined in claim 17 including a first electrolyte overflow means at said first level and a second electrolyte overflow means at said second level and means for selectively activating said second electrolyte overflow means to maintain said electrolyte at said second level.

19. The improvement as defined in claim 18 including means for maintaining a positive potential on said first and second electrodes irrespective of the electrolyte being at said first and second levels.

20. The improvement as defined in claim 18 including switching means for selectively removing the positive potential from said first anode.

21. The improvement as defined in claim 17 including means for maintaining a positive potential on said first and second electrodes irrespective of the electrolyte being at said first and second levels.

22. The improvement as defined in claim 17 including switching means for selectively removing the positive potential from said first anode.

* * * * *

UNITED STATES PATENT AND TRADEMARK OFFICE

CERTIFICATE OF CORRECTION

PATENT NO. : 4,183,799

DATED : January 15, 1980

INVENTOR(S) : Thomas A. Sellitto; Allen W. White

It is certified that error appears in the above-identified patent and that said Letters Patent are hereby corrected as shown below:

In the drawings, Sheet 2, Fig. 3, the reference numeral 136 should read -- 130 --; Sheet 6, Fig. 18, the reference numeral 376 should read -- 370 --, and the lead line from reference numeral 312 should be shortened to extend only to the opening in side wall 308. Column 1, line 34, "traps" should read -- trays --; lines 53 and 68, "ampers" should read -- amperes --. Column 4, line 39, delete "and"; line 56, "cross-sectioned" should read -- broken away --; line 67, after "showing" insert -- electrical --. Column 5, line 12, after "showing" insert -- electrical --; line 14, after "invention" insert -- shown in FIGS. 12 and 13 --; line 39, after "width" insert the reference letter -- W --, and after "strip" delete the reference letter W and substitute the reference letter -- B --. Column 6, line 6, "materials" should read -- material --; line 58, "ampers" should read -- amperes --. Column 7, line 33, after "width" insert the reference letter -- W --, and after "strip" delete the reference letter W and substitute the reference letter -- B --; Column 8, line 58, "greater" should read -- lesser -- Column 9, line 27, "controured" should read -- contoured --, line 49, "of" should read -- at --. Column 10, line 4, "Figs." should read -- Fig. --; line 5, the reference numeral

UNITED STATES PATENT AND TRADEMARK OFFICE

CERTIFICATE OF CORRECTION

PATENT NO. : 4,183,799

DATED : January 15, 1980

INVENTOR(S) : Thomas A. Sellitto; Allen W. White

It is certified that error appears in the above-identified patent and that said Letters Patent are hereby corrected as shown below:

"200" should read -- 220 --; lines 9 and 10, "ampers" should read -- amperes --. Column 11, line 6, "from" should read -- to --; line 7, "to" should read -- from --. Column 11, line 52 (claim 1), after "metal" insert a comma (,); line 58 (claim 1), after "cathode" insert a comma (,). Column 12, line 18 (claim 1), "second" should read -- first --; lines 53 (claim 9), 58 (claim 10) and 63 (claim 11), "apparatus" should read -- aperture --.

Signed and Sealed this

*Seventh* Day of *October 1980*

[SEAL]

*Attest:*

SIDNEY A. DIAMOND

*Attesting Officer*

*Commissioner of Patents and Trademarks*